US007661150B2

(12) United States Patent
Hess

(10) Patent No.: US 7,661,150 B2
(45) Date of Patent: Feb. 16, 2010

(54) GRASPING GLOVE AND METHOD OF FINGER RESTRAINING THERAPY

(76) Inventor: Darla J Hess, 99 Longs Rd., Bloomsburg, PA (US) 17815

( * ) Notice: Subject to any disclaimer, the term of this patent is extended or adjusted under 35 U.S.C. 154(b) by 0 days.

(21) Appl. No.: 10/905,310

(22) Filed: Dec. 27, 2004

(65) Prior Publication Data

US 2005/0193464 A1 Sep. 8, 2005

Related U.S. Application Data

(60) Provisional application No. 60/546,412, filed on Feb. 20, 2004.

(51) Int. Cl.
*A41D 19/00* (2006.01)

(52) U.S. Cl. ..... 2/160; 2/159; 2/163

(58) Field of Classification Search ..... 2/160, 2/16, 21, 159, 161.1, 161.2, 161.5, 161.6, 2/161.7, 163; 128/878, 879, 880; 482/47, 482/48; 602/12, 20, 21, 22
See application file for complete search history.

(56) References Cited

U.S. PATENT DOCUMENTS 474,929 A * 5/1892 Tabor ..... 2/163
1,247,183 A 11/1917 Usterud
3,508,280 A * 4/1970 Osborn ..... 2/159
3,559,212 A 2/1971 Skovron
3,608,093 A * 9/1971 Kirby ..... 2/163
3,787,898 A 1/1974 Walker
4,665,565 A * 5/1987 Odom ..... 2/161.2
4,781,178 A * 11/1988 Gordon ..... 602/22
5,680,654 A * 10/1997 McClanahan, II ..... 2/163
6,338,163 B1 * 1/2002 Markson ..... 2/163
7,051,377 B1 * 5/2006 Milner et al. ..... 2/159

* cited by examiner

*Primary Examiner*—Gary L Welch
*Assistant Examiner*—Sally C Cline
(74) *Attorney, Agent, or Firm*—John J. Elnitski, Jr.

(57) ABSTRACT

A grasping glove for fine motor skills therapy of a hand of a user. The grasping glove includes a main covering having a palm side and a back side. The grasping glove includes a little finger covering extending from said main covering. The grasping glove includes a ring finger covering extending from said main covering. The grasping glove includes a palm side to finger covering attachment between said little finger and said palm side of said main covering. The grasping glove includes a palm side to finger covering attachment between said ring finger and said palm side of said main covering. A method of treating deficiencies in finger fine motor skills of hand of a person by restraining a little finger of the hand toward a palm side of the hand and restraining a ring finger of the hand toward the palm side of the hand.

19 Claims, 7 Drawing Sheets

GRASPING GLOVE AND METHOD OF FINGER RESTRAINING THERAPY

BACKGROUND

The present invention generally relates to devices and therapy to improve the grasp ability of a person. More specifically, the present invention relates to gloves and finger restraining therapy to improve the grasp ability of a person.

Some children can have delays in development of finger fine motor skills, as well as there being learning and physically disabled children who do not properly develop their finger fine motor skills. Certain hand injuries would have a better outcome for recovery if specific finger isolation movements which have been lost due to the injury can exercised. People who have suffered a stroke tend to recover with significant gross upper extremity movement regained, while developing "substitution" movements and losing any possibility of regaining finger fine motor skills. Finger fine motor skills require isolated finger movements as well as specific grasps such as the tripod grasp and pincer grasp. Therapists need a development tool to aid in developing finger fine motor skills for all of those mentioned above.

It is an object of the present invention to provide a glove as a development tool to aid in developing finger fine motor skills for those who need to develop or have lost finger fine motor control and coordination due to learning disabilities, illness or hand injuries.

It is an object of the present invention to provide a method of finger restraining therapy to improve finger fine motor skills.

SUMMARY OF THE INVENTION

A grasping glove for fine motor skills therapy of a hand of a user. The grasping glove includes a main covering having a palm side and a back side. The grasping glove includes a little finger covering extending from said main covering. The grasping glove includes a ring finger covering extending from said main covering. The grasping glove includes a palm side to finger covering attachment between said little finger and said palm side of said main covering. The grasping glove includes a palm side to finger covering attachment between said ring finger and said palm side of said main covering. A method of treating deficiencies in finger fine motor skills of hand of a person by restraining a little finger of the hand toward a palm side of the hand and restraining a ring finger of the hand toward the palm side of the hand.

DETAILED DESCRIPTION

The present invention is a grasping glove 10 to be used as a development tool to aid in developing functional grasps and finger fine motor skills during therapy. The present invention is also a method of restraining fingers of the hand during therapy to promote finger fine motor skills. FIGS. 1-7 show different embodiments of the grasping glove 10. The main component of the grasping glove 10 is a main covering 12 which fits over the hand of the user, as shown in FIGS. 1-7. The main covering 12 has a palm side 14 and a back side 16. The grasping glove 10 provides for specific finger isolation movements to aid in the therapy of the user to develop finger fine motor skills. The grasping glove 10 inhibits the tendency of the user to use gross hand grasps and forces the use of more refined grasps.

Figure 1:
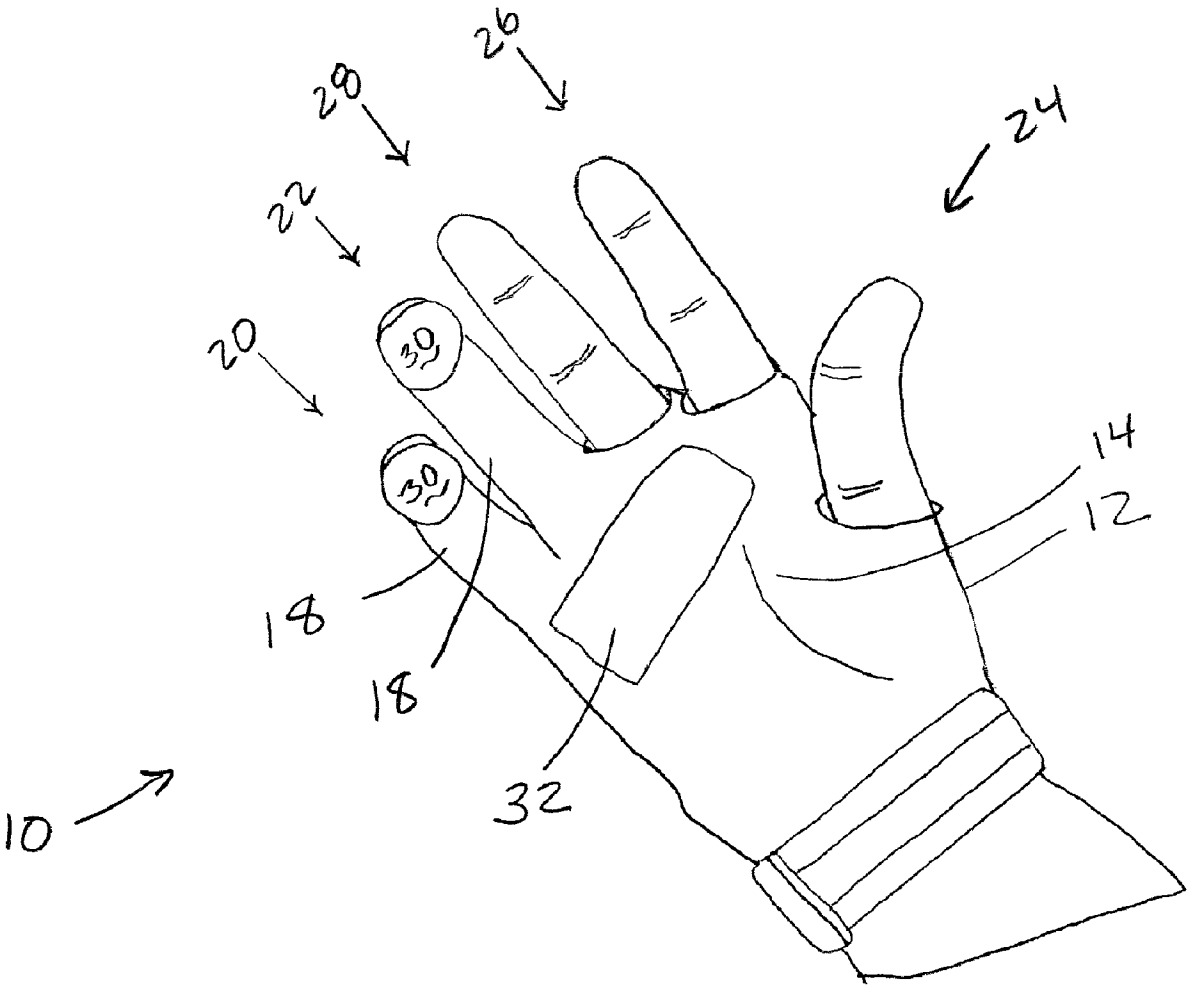
FIG. 1 is a perspective view of a grasping glove according to the present invention.
Figure 2:
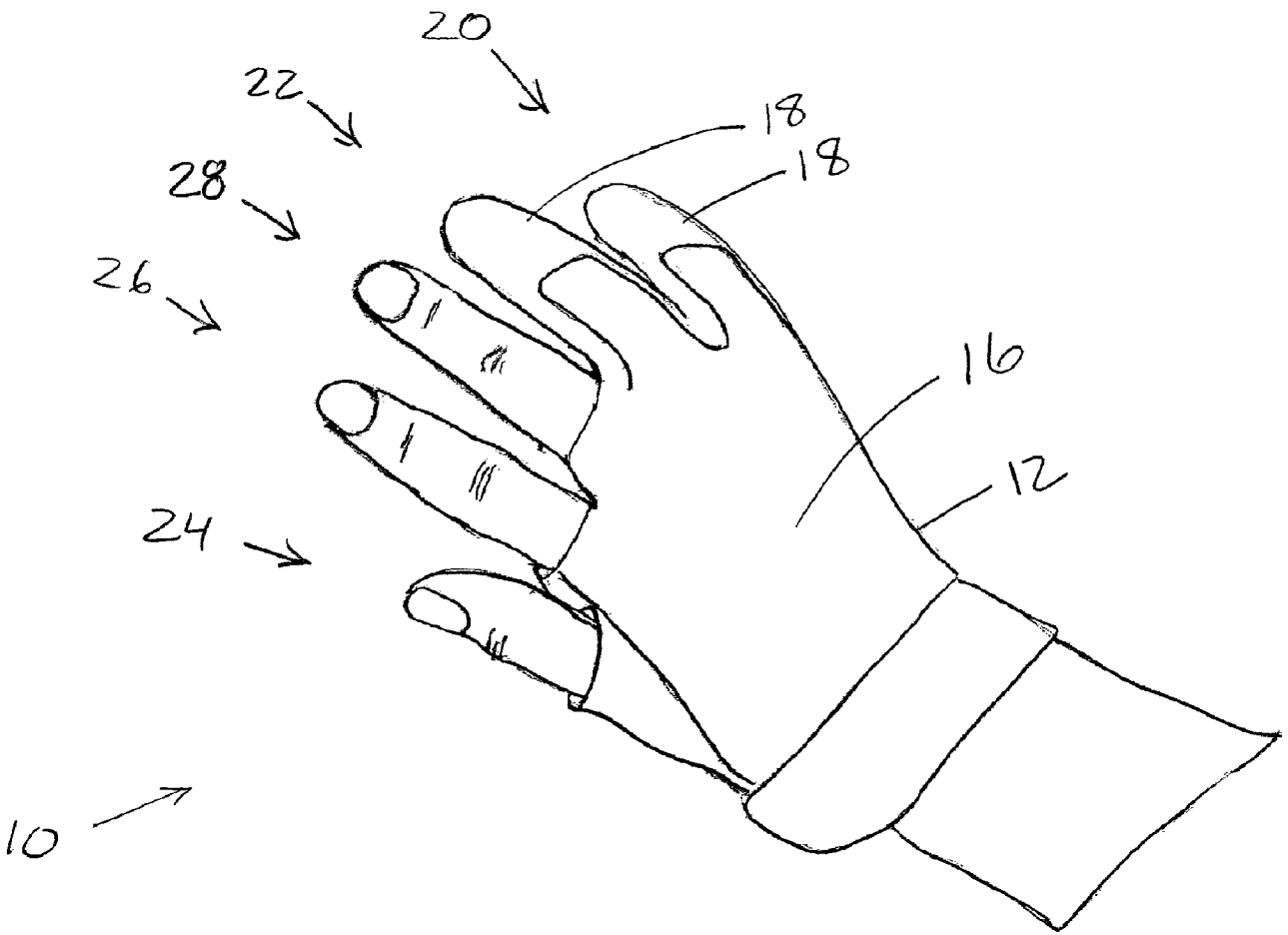
FIG. 2 is a perspective view of a grasping glove according to the present invention.

FIGS. 1-2 show the main covering 12 with finger coverings 18 for the little finger 20 and the ring finger 22 and without finger coverings for the thumb 24, index finger 26 and the middle finger 28. A hook and loop fastener is used with the grasping glove 10 of FIGS. 1-2. The hook and loop fastener includes a first part 30 and a second part 32, whereby mating the first part 30 and second part 32 together secures the first part 30 and second part 32 together until sufficient force is used to pull them apart. Two pieces of the first part 30 of the hook and loop fastener are attached to the finger coverings 18 of the ring finger 22 and little finger 20. The second part 32 of the hook and loop fastener is attached to the palm side 14 of the main covering 12 in an area between the middle of the palm side 14 and where the finger coverings 18, 20, 22, and the main covering 12 connect together. The first part 30 and second part 32 of the hook and loop fastener together forms a palm side to finger covering attachment system. The little finger 20 and the ring finger 22 can be attached to the palm side 14 of the main covering 12 in a fixed position to restrain the little finger 20 and the ring finger 22. The thumb 24, index finger 26 and the middle finger 28 are free without any finger covering 18 to hold writing tools and perform fine grasp movements. The restraining of the ring finger 22 and little finger 20 with the hook and loop fastener basically prevents the hand from using non-functional gross grasps. The fixing of the ring finger 22 and little finger 20 promotes normal grasps such as using a pencil, cutting with scissors, picking up and manipulating small objects, as well as performing tasks requiring fine motor skills such as buttoning buttons, using zippers and feeding utensils. Some functional activities with the ring finger 22 and little finger 20 fixed to the palm side 14 while using the thumb 24, index finger 26 and middle finger 28 are associated with the tripod grasp. The tripod grasp includes holding and using objects such as pens, pencils, crayons, paint brushes, tongs and tweezers. Other grasps requiring two fingers and the thumb 24 are picking up larger objects requiring the dexterity and strength of three fingers such as golf ball size objects, milk cartons, picking up a coffee cup, using a comb, screwing/unscrewing larger caps, turning knobs, pulling open drawers, holding and moving a computer mouse, rolling paper or clay between the fingers. The use of the thumb 24, index finger 26 and middle finger 28 is required to use scissors effectively. While either the little finger 20, ring finger 22, or both are attached to the palm side 14 of the main covering 12, the remaining fingers and thumb 24 remain free to perform finger-thumb opposition exercises and activities, as well as strengthening individual fingers or a combination of fingers. For example, performing "pinching" exercises as pinching a clothes pin or similar exercise device increase strength of the web space which is important for holding writing utensils.

FIGS. 3-6 shows the grasping glove 10 with finger coverings 18 for the little finger 20, ring finger 22 and middle finger 28 and without finger coverings for the thumb 24 and index finger 26. FIGS. 3-6 differ from FIGS. 1-2, as there is a finger covering 18 for the middle finger 28. A hook and loop fastener is used with the grasping glove 10 of FIGS. 3-6. Three pieces of the first part 30 of the hook and loop fastener are attached to the finger coverings 18 of the middle finger 28, ring finger 22 and little finger 20. The second part 32 of the hook and loop fastener is attached to the palm side 14 of the main covering 12. The first part 30 and second part 32 of the hook and loop fastener forms a palm side to finger covering attachment system. The middle finger 28, ring finger 22 and little finger 20 can be attached to the palm side 14 of the main covering 12 in a fixed position to restrain the middle finger 28, ring finger 22 and little finger 20. The thumb finger 24 and index finger 26 are free without any finger covering 18. Having the middle finger 28, ring finger 22 and little finger 20 in a restrained position promotes only two digit grasps such as the pincer grasp. The pincer grasp uses only the thumb 24 and index finger 26 to pick up small objects such as marbles, coins, paperclips, beads, game pieces, finger foods, writing instruments, and many more small objects used in daily life. Also, the pincer grasp is used for turning pages, tearing open packages/paper, opening ziplock bags, turning and flipping objects over, turning nuts on screws, zipping/unzipping zippers, managing buttons, putting on/taking off glasses, and opening milk cartons. Other tasks performed by the thumb 24 and index finger 26 are the lateral pincer grasp or key grasp, which include holding papers, using a key, holding a fork/spoon, and holding a tooth pick. While either the little finger 20, ring finger 22, middle finger 28 or a combination of two or three of the little finger 20, ring finger 22, middle finger 28 are attached to the palm side 14 of the main covering 12, the remaining fingers and thumb 24 remain free to perform finger-thumb opposition exercises and activities as well as strengthening individual fingers or a combination of fingers. For example, performing "pinching" exercises as pinching a clothes pin or exercise device increase strength of the web space which is important for holding writing utensils.

Figure 3:
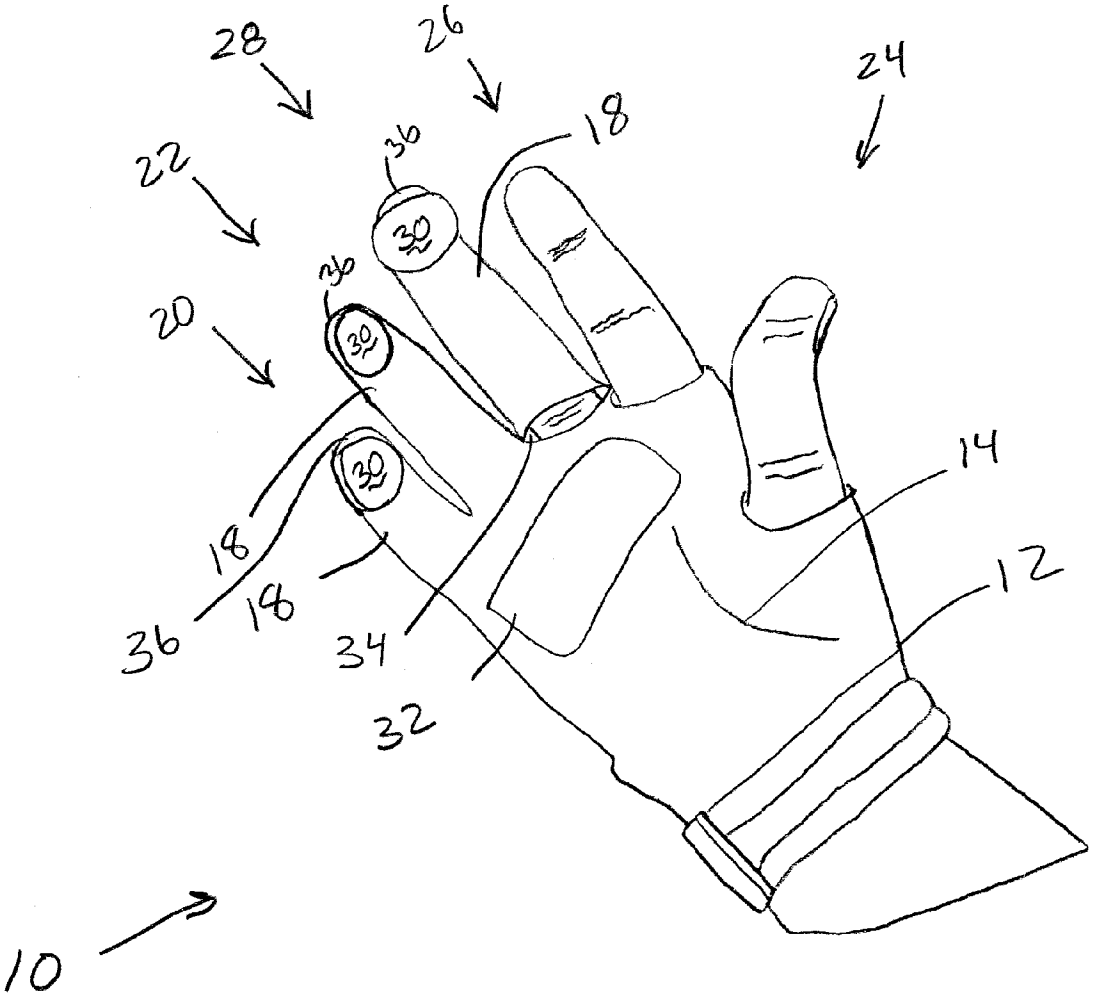
FIG. 3 is a perspective view of a grasping glove according to the present invention.
Figure 4:
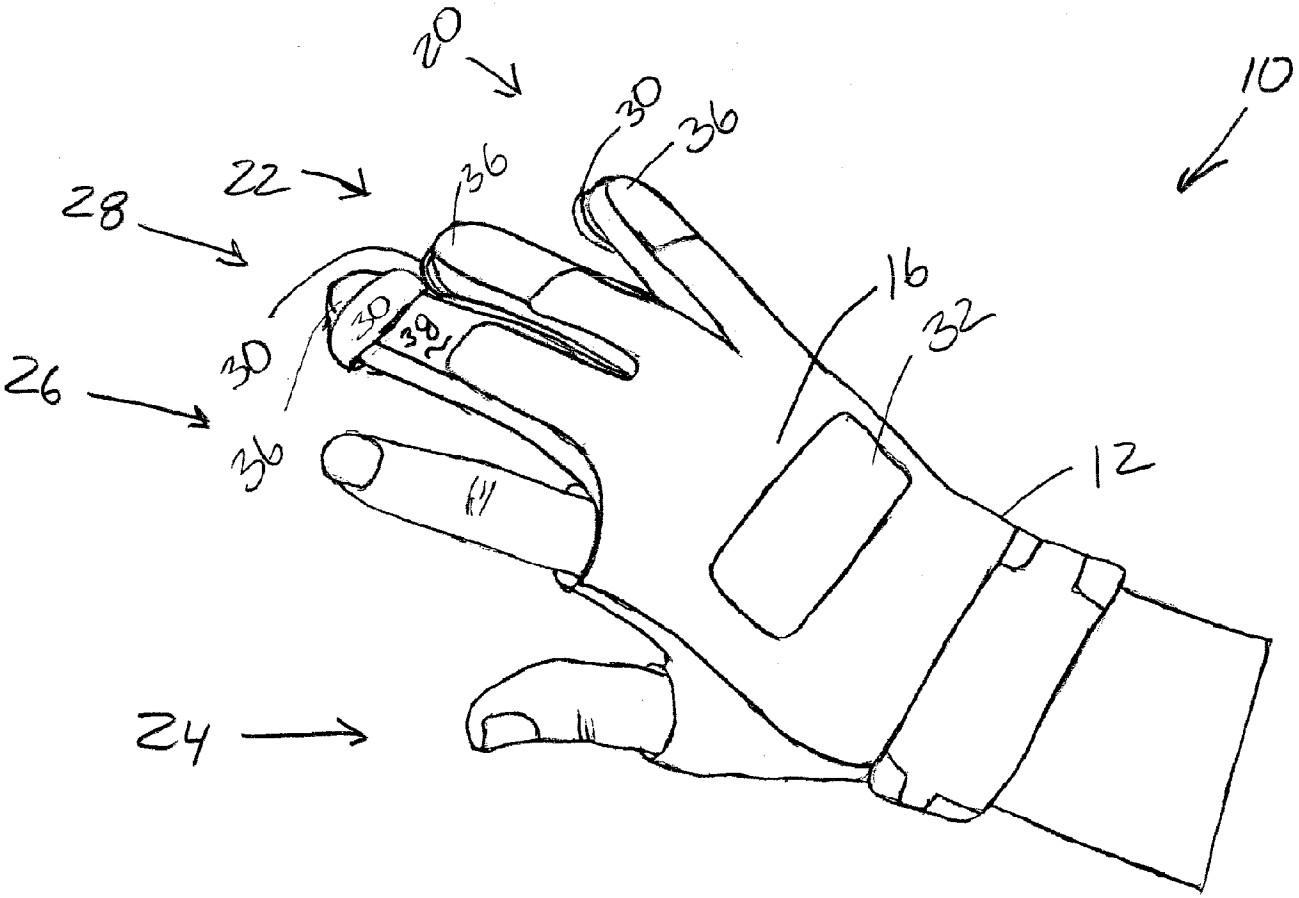
FIG. 4 is a perspective view of a grasping glove according to the present invention.
Figure 5:
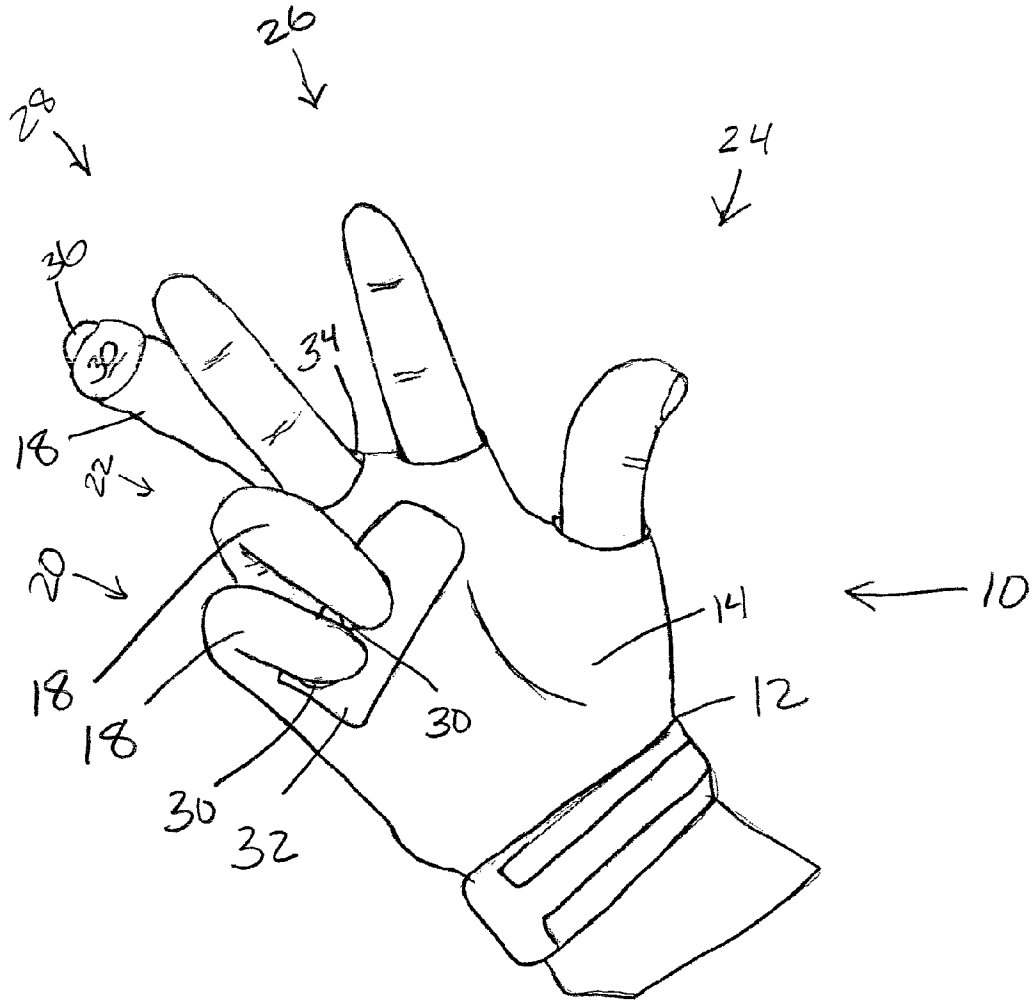
FIG. 5 is a perspective view of a grasping glove according to the present invention.
Figure 6:
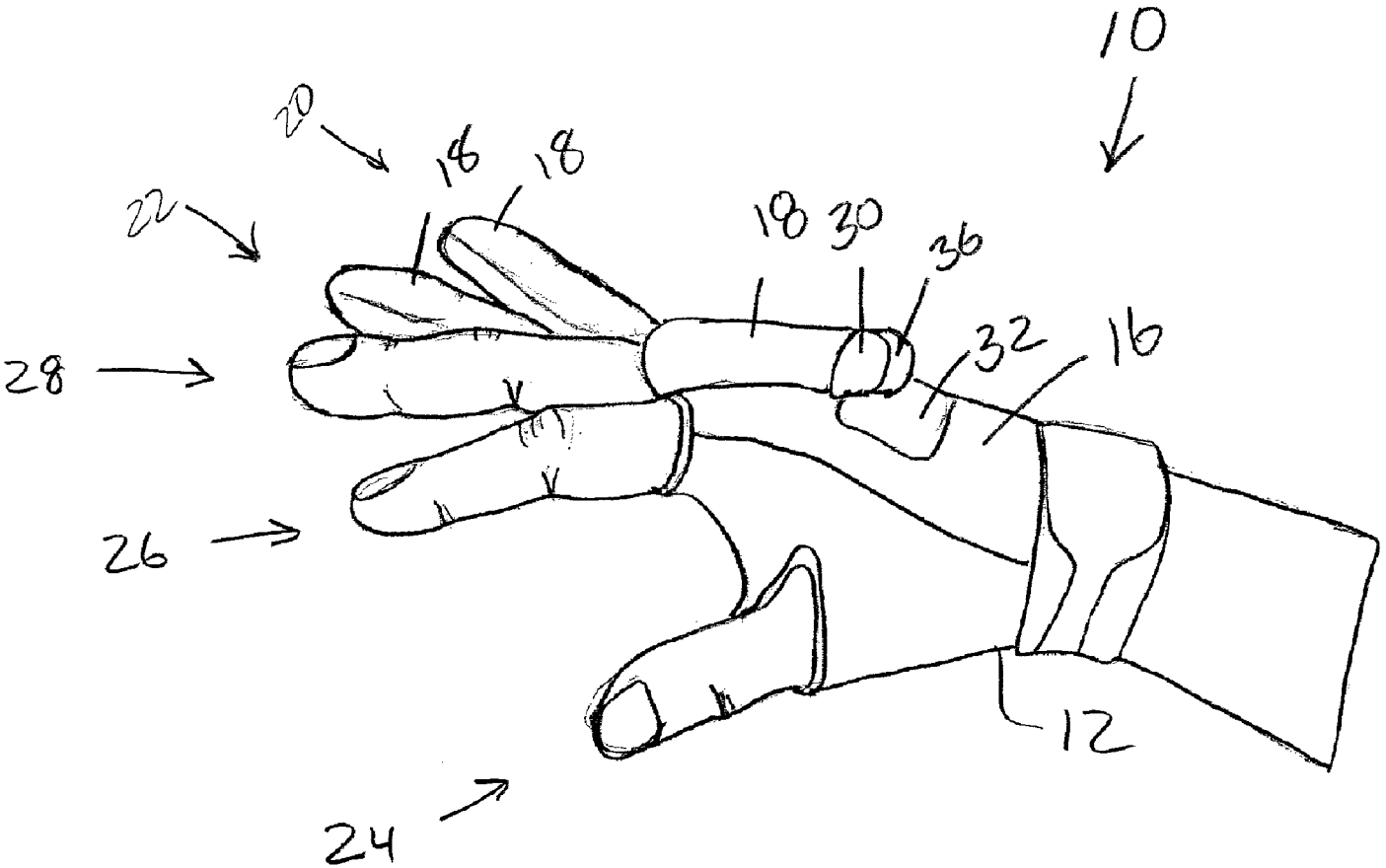
FIG. 6 is a perspective view of a grasping glove according to the present invention.

FIGS. 3 and 5 show a slit 34 at the base of the finger covering 18 for the middle finger 28, between the palm side 14 of the main covering 12 and the finger covering 18. The slit 34 allows the middle finger 28 to be freed from the finger covering 18, as shown in FIGS. 5-6. The slit 34 could be added to the other finger coverings 18. In addition, the first part 30 of the hook and loop fastener attached to the finger covering 18 of the middle finger 28 wraps completely around the tip 36 of the finger covering 18. This provides the first part 30 of the hook and loop fastener on the finger covering 18 of the middle finger 28 on a back side 38 of the finger covering 18. A second part 32 of the hook and loop fastener similar to the second part 32 of the hook and loop fastener attached to the palm side 14 of the main covering 12 is shown attached to the back side 16 of the main covering 12. The first part 30 and second part 32 of the hook and loop fastener forms a back side to finger covering attachment system. The first part 30 of hook and loop fastener allows attachment of finger covering 18 of the middle finger 28 to the second part 32 of hook and loop fastener on the back side 16 of the main covering 12. When the finger covering 18 of the middle finger 28 is removed from the middle finger 28 and attached to the back side 16 of the main covering 12, the grasping glove 10 of FIGS. 3-6 acts the same as the grasping glove 10 of FIGS. 1-2. The fact that the first part 30 of hook and loop fastener wraps around the finger covering 18 of the middle finger 28 allows specifically for the middle finger 28 while in the finger covering 18 to be hook and loop fastened to an objects, such as a pencil, spoon, scissors, or pencil grip to ensure a proper tripod grip on the object. Whereby, the object would have the second part 32 (not shown) of the hook and loop fastener incorporated on the object to keep the middle finger 28 in proper placement on the object.

Figure 7:
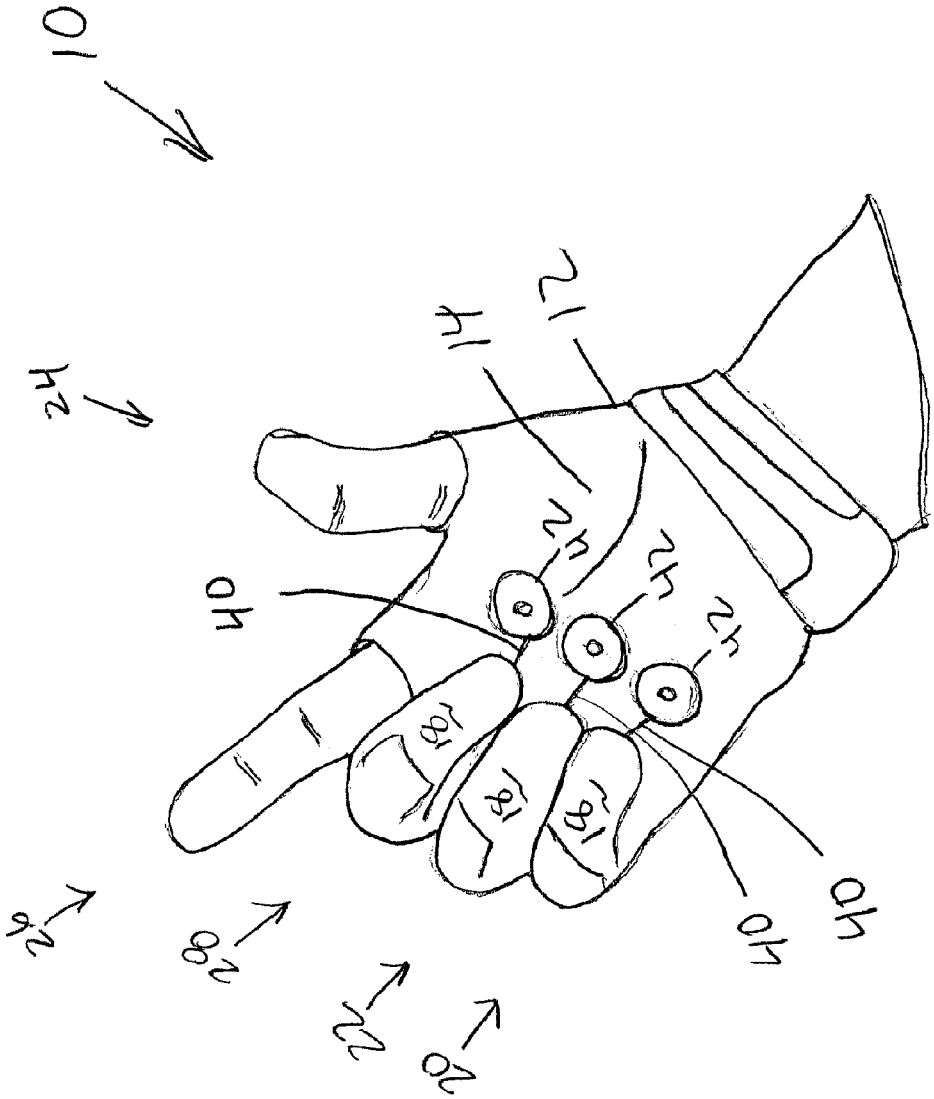
FIG. 7 is a perspective view of a grasping glove according to the present invention.

The hook and loop fastener can be replaced with other devices to promote the finger covering 18 attachment to the main covering 12. One example is shown in FIG. 7. FIG. 7 shows strings 40 extending outward from the tips 36 of the finger coverings 18. Buttons 42 are shown attached to the palm side 14 of the main covering 12. The string 40 from the finger coverings 18 is wrapped around the buttons 42 to attach the finger coverings 18 to the palm side 14 of the main covering 12. The string 40 and button 42 combination is especially helpful when the user can not move their fingers enough to reach the palm side 14 of the main covering 12. The fingers are still held in place due to the tension of the string 40.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

What is claimed is:

1. A grasping glove, for therapeutic development of functional grasps and enhancement of fine motor skills of a thumb, index finger and middle finger of a hand of a user, comprising:

a main covering which is adapted to fit over the hand of the user, said main covering having a palm side and a back side, said main covering having openings adapted to allow the thumb, index finger and middle finger to extend outward from said main covering free of any covering such that skin of the thumb, index finger and middle finger is exposed;

a little finger covering extending from said main covering adapted for covering a little finger of the hand of the user;

a ring finger covering extending from said main covering adapted for covering a ring finger of the hand of the user;

a palm side to finger covering attachment system between said little finger and said palm side of said main covering to hold the little finger in a position to promote the proper use of the thumb, index finger and middle finger in exercises for therapeutic development of functional grasps and fine motor skills enhancement of the thumb, index finger and middle finger, said finger covering attachment system including a palm attachment device on said palm side which does not extend beyond an area between a middle of said palm side, said finger covering attachment system including a little finger attachment device on said little finger covering which is complimentary to said palm attachment device and where said little finger covering and said main covering connect together between said complimentary palm attachment device and little finger attachment device; and a palm side to finger covering attachment system between said ring finger and said palm side of said main covering to hold the ring finger in a position to promote the proper use of the thumb, index finger and middle finger in exercises for therapeutic development of functional grasps and fine motor skills enhancement of the thumb, index finger and middle finger, attachment device on said palm side which does not extend beyond an area between a middle of said palm side, said finger covering attachment system including a ring finger attachment device on said ring finger covering which is complimentary to said palm attachment device and where said ring finger covering and said main covering connect together between said complimentary palm attachment device and ring finger attachment device.

2. The grasping glove of claim 1, further including middle finger covering extending from said main covering adapted for covering a middle finger of the hand of the user and a palm side to finger covering attachment system between said middle finger and said palm side of said main covering to hold the middle finger in a position to promote the proper use of the thumb and index finger in exercises for therapeutic development of functional grasps and fine motor skills enhancement of the thumb and index finger.

3. The grasping glove of claim 2, wherein said palm side to finger covering attachment system for said little finger covering, said ring finger and said middle finger covering are hook and loop fasteners.

4. The grasping glove of claim 2, wherein said palm side to finger covering attachment system for said little finger covering, said ring finger and said middle finger covering are a string and a button.

5. The grasping glove of claim 2, wherein said middle finger covering includes an attachment device to fasten an object which is to be held and used by said user.

6. The grasping glove of claim 2, wherein said middle finger covering is removable from the middle finger while worn by the user.

7. The grasping glove of claim 6, wherein said palm side to finger covering attachment system for said little finger covering, said ring finger and said middle finger covering are hook and loop fasteners.

8. The grasping glove of claim 6, wherein said palm side to finger covering attachment system for said little finger covering, said ring finger and said middle finger covering are a string and a button.

9. The grasping glove of claim 6, further including a slit between said middle finger covering and said main covering on said palm side of said main covering, such that the middle finger of the user can be inserted into said slit so that the middle finger of the user is removed from said middle finger covering.

10. The grasping glove of claim 9, wherein said palm side to finger covering attachment system for said little finger covering, said ring finger and said middle finger covering are hook and loop fasteners.

11. The grasping glove of claim 9, wherein said palm side to finger covering attachment system for said little finger covering, said ring finger and said middle finger covering are a string and a button.

12. The grasping glove of claim 9, further including a back side to finger covering attachment system between said middle finger and said back side of said main covering.

13. The grasping glove of claim 12, wherein said palm side to finger covering attachment system for said little finger covering, said ring finger and said middle finger covering are hook and loop fasteners; and wherein said back side to finger covering attachment system for said middle finger covering is a hook and loop fastener.

14. The grasping glove of claim 1, wherein said palm side to finger covering attachment system for said little finger covering and said ring finger covering are hook and loop fasteners.

15. The grasping glove of claim 1, wherein said palm side to finger covering attachment system for said little finger covering and said ring finger covering are a string and a button.

16. A method of treating deficiencies in finger fine motor skills of hand of a person using a glove comprising:

providing the glove with finger coverings for a little finger, ring finger and middle finger of the hand;

providing the glove without finger coverings for an index finger and a thumb of the hand;

providing the glove with a palm side to the glove;

providing the glove with a back side to the glove;

fixing the finger covering of the little finger of the glove to the palm side of the glove in an area between a middle of the palm side of the glove and where the finger covering of the little finger and the glove connect in a complimentary way and fixing the finger covering of the ring finger of the glove to the palm side of the glove in an area between the middle of the palm side of the glove and where the finger covering of the ring finger and the glove connect in a complimentary way to inhibit the tendency of a user to use gross hand grasps and force the use of more refined grasps by the index finger and thumb.

17. The method of claim 16, further providing the glove with a removable finger covering for the middle finger and fixing the finger covering of the middle finger of the glove to the palm side of the glove to inhibit the tendency of a user to use gross hand grasps and force the use of more refined grasps by the index finger, middle finger and thumb.

18. The method of claim 16, including removing the middle finger from the covering of the middle finger to allow use of the middle finger without a finger covering to inhibit the tendency of a user to use gross hand grasps and force the use of more refined grasps by the index finger, middle finger and thumb.

19. The method of claim 16, further providing an attachment device on said middle finger covering to fasten an object which is to be held and used by said user.

* * * * *